US009916751B2

(12) United States Patent
Malhotra et al.

(10) Patent No.: US 9,916,751 B2
(45) **Date of Patent: *Mar. 13, 2018**

(54) LEARNED OVERRIDES FOR HOME SECURITY

(71) Applicant: Google Inc., Mountain View, CA (US)

(72) Inventors: Mark Rajan Malhotra, San Mateo, CA (US); Sophie Le Guen, Burlingame, CA (US); Jeffrey Alan Boyd, Novato, CA (US); Jeffery Theodore Lee, Los Gatos, CA (US); Todd Hester, San Francisco, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/348,126

(22) Filed: Nov. 10, 2016

(65) Prior Publication Data

US 2017/0061778 A1 Mar. 2, 2017

Related U.S. Application Data

(63) Continuation of application No. 14/585,469, filed on Dec. 30, 2014, now Pat. No. 9,520,049.

(51) Int. Cl.
*G08B 13/24* (2006.01)
*G08B 25/00* (2006.01)

(52) U.S. Cl.
CPC ..... *G08B 25/008* (2013.01); *G08B 13/2491* (2013.01); *G08B 25/009* (2013.01)

(58) Field of Classification Search
CPC ..... G08B 21/18; G08B 21/182; G08B 21/22; G08B 21/24; G08B 13/00; G08B 13/22;
(Continued)

(56) References Cited

U.S. PATENT DOCUMENTS 4,060,803 A * 11/1977 Ashworth, Jr. .... G08B 13/1672 340/506
4,461,221 A 7/1984 Schandle
(Continued)

FOREIGN PATENT DOCUMENTS

EP 1968023 A2 9/2008
EP 2431955 A2 3/2012

OTHER PUBLICATIONS

Teoh, et al., "A Neural Network Approach Towards Reinforcing Smart Home Security", Information and Telecommunication Technologies (APSITI), 2010 8th Asia-Pacific Symposium on, IEEE, Piscataway, NJ, USA, May 15, 2010, pp. 1-5.
(Continued)

*Primary Examiner* — Van Trieu
(74) *Attorney, Agent, or Firm* — Morris & Kamlay LLP

(57) ABSTRACT

Systems and techniques are provided for learned overrides for home security. A sensor of a security system may be armed. A trip signal may be received indicating a tripping of the sensor. It may be determined that the trip signal can be automatically overridden based on matching an identity of the sensor and a state of the security system with a pattern in a model. The pattern may represent a state of the security system in which automatically overriding the trip signal from the sensor is permitted. The trip signal from the sensor may be automatically overridden without input from a user.

36 Claims, 7 Drawing Sheets

(58) Field of Classification Search
CPC .... G08B 13/24; G08B 13/26; G08B 13/2491; G08B 25/00; G08B 25/008; G08B 25/009; G08B 25/12; G08B 31/00
See application file for complete search history.

(56) References Cited

U.S. PATENT DOCUMENTS

| | | | | |
|---|---|---|---|---|
| 5,461,372 | A | 10/1995 | Busak et al. | |
| 6,137,402 | A | 10/2000 | Marino | |
| 7,126,467 | B2 * | 10/2006 | Albert | A61B 7/003 340/407.1 |
| 7,916,018 | B2 | 3/2011 | Eskildsen et al. | |
| 9,064,394 | B1 | 6/2015 | Trundle | |
| 9,520,049 | B2 * | 12/2016 | Malhotra | G08B 13/2491 |
| 2006/0226977 | A1 | 10/2006 | Delozier et al. | |
| 2012/0019353 | A1 | 1/2012 | Knasel | |
| 2012/0084857 | A1 | 4/2012 | Hubner | |
| 2013/0257611 | A1 | 10/2013 | Lamb et al. | |

OTHER PUBLICATIONS

PCT/US2015/065602, International Search Report and Written Opinion issued in PCT/US2015/065602 dated Apr. 5, 2016, dated Apr. 5, 2016, p. 18.

Mikrut, et al., "Combining Pattern Matching and Optical Flow Methods in Home Care Vision System", Information Technologies in Biomedicine, Springer Berlin Heidelberg, Berlin, Heidelberg, vol. 7339, Jun. 11, 2012, pp. 537-548.

Han, et al., "A Review of smart homes—Present state and future challenges", Computer Methods and Programs in Biomedicine, Elsevier, Amsterdam, NL, vol. 91, Jul. 31, 2008, pp. 55-81.

IPRP dated Jul. 13, 2017 as received in Application No. PCT/US2015/065602.

* cited by examiner

LEARNED OVERRIDES FOR HOME SECURITY

CROSS-REFERENCE TO RELATED APPLICATIONS

The present Application for Patent is a continuation of U.S. Non-Provisional patent application Ser. No. 14/585,469, entitled "LEARNED OVERRIDES FOR HOME SECURITY", filed Dec. 30, 2014, now U.S. Pat. No. 9,520,049, assigned to the assignee hereof, and expressly incorporated herein by reference in its entirety.

BACKGROUND

A security system may be part of a smart home environment that may monitor the state of various entryways into the home, including, for example, doors and windows. The security system may include sensors for each entryway, which may trigger an alert when the security system and sensors are armed and the entryway that a sensor is monitoring is opened. People may tend to leave the same windows or other entryways open when they arm the home security system. For example, a person may leave a particular bedroom window open every night that they are in the home. This may require that a user of the security system manually override the sensor on the open entryway every time the entryway is left open to prevent the security system from being triggered by the sensor on the open entryway. The user may also set the security system to never arm the sensor on that particular entryway.

BRIEF SUMMARY

According to an embodiment of the disclosed subject matter a sensor of a security system may be armed. A trip signal may be received indicating a tripping of the sensor. It may be determined that the trip signal can be automatically overridden based on matching an identity of the sensor and a state of the security system with a pattern in a model. The pattern may represent a state of the security system in which automatically overriding the trip signal from the sensor is permitted. The trip signal from the sensor may be automatically overridden without input from a user.

A trip signal indicating a tripping of a second sensor may be received. It may be determined, based on either matching an identity of the second sensor and the state of the security system with another pattern in the model, where the another pattern represents a state of the security system in which automatically overriding the trip signal from the sensor is not permitted, or not matching the identity of the second sensor and the state of the security system with any pattern in the model, that the trip signal from the second sensor cannot be automatically overridden. An override request may be displayed on a computing device associated with a user of the security system. The computing device may be a hub computing device of the security system or a personal computing device of the user.

A response to the override request may be received indicating that the trip signal from the second sensor is to be overridden. The trip signal from the second sensor may be overridden. The model may be updated based on the trip signal from the second sensor and the state of the security system. Updating the model may include either adding a new pattern to the model, the new pattern including the identity of the second sensor, the state of the security system, and the response to the override request, or updating the another pattern with the response to the override request.

A response to the override request may be received indicating that the trip signal from the second sensor is not to be overridden. An alarm, an alert, or a notification that the sensor has generated a trip signal may be generated.

Determining that the trip signal can be automatically overridden based on matching an identity of the sensor and a state of the security system with a pattern in a model, where the pattern represents a state of the security system in which automatically overriding the trip signal from the sensor is permitted may include determining that the state of the security system and the entryway sensor matches a pattern in the model based on parameter-based matching, probabilistic matching, statistical matching, or machine learning-based matching, and determining that the matched pattern permits automatically overriding the trip signal from the entryway sensor. The patterns in the model may be parameter-based, probabilistic, statistical, or machine learning based.

Updating the pattern in the model based on the trip signal from the second sensor and the state of the security system may include updating the pattern to permit automatically overriding the trip signal from the second sensor.

The state of the security system may include a state of other sensors connected to the security system, the presence of persons within an environment monitored by the security system, time of day, a day of the week, a day of the month, a month of the year, a climate within the environment monitored by the security system, a climate outside the environment monitored by the security system, and a mode of the security system.

The sensor may remain armed while the trip signal from the sensor is overridden.

According to an embodiment of the disclosed subject matter, a means for arming a sensor of a security system, a means for receiving a trip signal indicating a tripping of the sensor, a means for determining that the trip signal can be automatically overridden based on matching an identity of the sensor and a state of the security system with a pattern in a model, where the pattern represents a state of the security system in which automatically overriding the trip signal from the sensor is permitted, a means for automatically overriding the trip signal from the sensor without input from a user, a means for receiving a trip signal indicating a tripping of a second sensor, a means for determining, based on either matching an identity of the second sensor and the state of the security system with another pattern in the model, where the another pattern represents a state of the security system in which automatically overriding the trip signal from the sensor is not permitted, or not matching the identity of the second sensor and the state of the security system with any pattern in the model, that the trip signal from the second sensor cannot be automatically overridden, a means for displaying an override request on a computing device associated with a user of the security system, a means for receiving a response to the override request indicating that the trip signal from the second sensor is to be overridden, a means for overriding the trip signal from the second sensor, a means for updating the model based on the trip signal from the second sensor and the state of the security system, where updating the model includes a means for adding a new pattern to the model, the new pattern including at least the identity of the second sensor, the state of the security system, and the response to the override request, and a means for updating the another pattern with the response to the override request, a means for receiving a response to the override request indicating that the trip signal from the second sensor is not to be overridden, a means for generating an alarm, an alert, or a notification indicating that the sensor has generated a trip signal, a means for determining that the state of the security system and the entryway sensor matches a pattern in the model based on parameter-based matching, probabilistic matching, statistical matching, or machine learning-based matching, a means for determining that the matched pattern permits automatically overriding the trip signal from the entryway sensor, and a means for updating the at least one pattern to permit automatically overriding the trip signal from the second sensor, are included.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
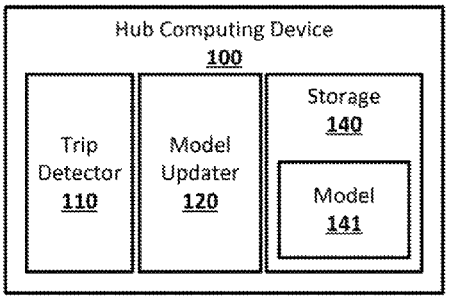
FIG. 1 shows an example system suitable for learned overrides according to an implementation of the disclosed subject matter.

According to embodiments disclosed herein, learned overrides may allow a security system for a smart home environment to learn when tripping from particular entryway sensors may be automatically overridden. This may allow the resident of a home to leave a certain window open, at all times, or seasonally, and still arm the security system without having a sensor monitoring the open window trip, and without having the security system never arm the sensor. When a security system mode is selected, the security system may arm various entryway sensors throughout an environment based on the selected mode. The environment may be a structure, such a home or building, or a space that does not include an entire structure, such as an apartment or office, and may include both enclosed and unenclosed areas. For example, an armed mode may arm every entryway sensor in an environment. If an entryway is open, a sensor monitoring the entryway may trip, generating a trip signal. The security system may check a model to determine if the trip signal can be automatically overridden. If the model does not indicate that the trip signal can be automatically overridden, the security system may send a request to a user of the security system to override the trip signal. The user may choose to override the trip signal. The security system may update the model based on the user's choice to override and the current state of the security system. Once the user has chosen to override the trip signal from the sensor monitoring the same entryway in the same or similar system states, the security system may automatically override future trip signals from the sensor monitoring that entryway.

A security system may include a hub computing device, which may be any suitable computing device for managing a security system, and may also manage an automation system including other functions beyond security. The hub computing device may be a controller for a smart home environment. For example, the hub computing device may be or include a smart thermostat. The hub also may be another device within the smart home environment, or may be a separate computing device dedicated to managing the smart home environment. The hub computing device may be connected, through any suitable wired and wireless connections, to a number of sensors distributed throughout an environment. Some of the sensors may, for example, detect the state of entryways such as doors and windows. For example, magnetic contact sensors, tilt sensors, or any other suitable sensors may be used to detect whether a door or window is opened. When such a sensor is armed and detects that an entryway is open, the sensor may trip, and may generate a trip signal. The hub computing device may receive the signal indicating the trip, and depending on the mode of the security system, may sound an alarm or otherwise generate an alert or notification to a user of the home security system or other appropriate party, such as a security service, indicating that the entryway is open. The sensor may directly signal that it has been tripped, or the tripping of the sensor may be interpreted by the hub computing device based on a status signal from the sensor. For example, a magnetic contact sensor may send a signal indicating whether it is open or closed, and the hub computing device may interpret an open signal as a tripping of the magnetic sensor when the magnetic sensor is armed. Alternatively, the magnetic contact sensor may be able to send a separate signal, apart from an open or closed signal, indicating that it has been tripped.

The occupants of an environment, such as the residents of a home, may wish to be able to leave certain entryways open even when the security system is in a mode in which the sensors monitoring the entryways are armed. For example, a resident of a house may wish to leave a particular bedroom window open every night. Leaving an entryway open may trip the sensor monitoring the entryway when the security system attempts to arm the sensor. This tripping may be reported to the hub computing device. The hub computing device may check a model, which may be stored in any storage accessible to the hub computing device. The model may include different states of the security system, or patterns, in which it may be permissible to automatically override the trip signal from the entryway sensor. A pattern in the model may include, for example, the mode to which the security system is set, the time of day, day of week, day of month, and day of year, the state of other sensors connected to the security system, and the presence of people in the environment identified in any suitable manner, including through WiFi and Bluetooth devices such as mobile phones, smart watches and other wearable devices, fobs, biometric scans, and the like.

If the current state of the security system matches, or is close enough to, a pattern in the model for which automatic overrides are allowed, then the security system may automatically override the trip signal from the entryway sensor. This may prevent the security system from generating an alert based on the tripping of the entryway sensor. A match may be determined in any suitable manner, including through exact matching of the security system state, probabilistic matching, or confidence levels determined through, for example, any suitable machine learning system. The current state may be close enough to a pattern in the model when, for example a threshold percentage of parameters of parameters of the currents state are the same as in the pattern, or when, for example, a machine learning system determines with a level of confidence that exceeds a threshold that the current state matches the pattern. This may allow for automatic overrides even when there are minor variances between the current state of the security system and a pattern in the model. Matching may be based on the identity of the sensor that was tripped. For example, a pattern may be matched when a trip signal is received from a particular window sensor, but may not be matched when a trip signal is generated by a different window sensor, or a door sensor, even if the security system is otherwise in a state that would match the pattern.

If the current state of the security system does not match a pattern in the model, or matches a pattern for which automatic overrides are not yet allowed, it may not be permissible for the security system to automatically override the trip signal from the entryway sensor. The hub computing device may send an override request to a user, for example, a resident of a home, occupant of a building, or other authorized user of the security system, asking the user if they wish to override the trip signal from the entryway sensor. The override request may be sent to the user in any suitable manner. For example, the override request may be displayed on a display of the hub computing device, or on any other suitable computing device accessible to a user and connected to the security system, such as a smartphone, tablet, laptop, desktop, or smart television. The override request may ask the user if they wish to continue to arm the security system while bypassing or overriding the tripping sensor on the open entryway.

The user may respond to the override request by indicating to the security system that the trip signal from the entryway sensor should be overridden. The security system may override the trip signal from the entryway sensor in any suitable manner. For example, the security system may disarm the entryway sensor, while allowing any other armed sensors to remain armed, or may keep the entryway sensor armed, but ignore any trip signals or trip signals of a particular type reported by the entryway sensor. For example, a periodic trip signal indicating that a window remains partially open may be ignored, while a trip signal indicating that the window has been opened completely or a trip signal indicating that a sensor associated with the window has been tampered with or disabled may not be ignored. The security system may update the stored model based on the current state of the security system and the override indication from the user. The model may be updated in any suitable manner, for example, using any suitable machine learning system. If a pattern in the model was matched, the pattern may be updated with the user's feedback to the override request. If no pattern was matched, a new pattern may be added to the model based on the user's feedback to the override request and the current state of the security system.

When a user has indicated that trip signals from a particular entryway sensor should be overridden a number of times when a given pattern is matched, future trip signals from the entryway sensor detected when that given pattern is matched may be automatically overridden by the security system. This may allow the security system to learn overrides from user feedback, so that the user does not have to override a trip signal from the same entryway sensor every time the entryway is left open so long as the state of the security system is the same or similar enough to be considered a match to a pattern in the model for which automatic overrides are permissible. For example, the resident of a house may leave the same window open at night. After receiving an indication several times that a trip signal from the sensor monitoring the window should be overridden, the security system may no longer send an override request to the resident when the sensor for the entryway trips, and may instead automatically override the trip signal. This may allow the resident to keep the window open without having to override the trip signal from the sensor monitoring the window every time the window is open and the sensor monitoring the window is armed.

If a user responds to an override request by indicating that the trip signal should not be overridden, or if the security system determines that a trip signal should not be ignored, the security system may treat the trip signal as it would any other trip signal. For example, the security system may generate an alert or alarm of any suitable type, or notify any suitable party, such as a security company, of the trip signal. The model may or may not be updated when the trip signal is not overridden, depending on how the security system is configured to learn when to override trip signals from entryway sensors.

The patterns of the model may be any suitable representation of a state of the security system. The patterns of the model may have any suitable level of complexity, and may permit automatic overriding after any suitable number of override indications from a user. For example, a pattern in the model may be based only a single indication from the user regarding whether to override a trip signal from a sensor monitoring a particular entryway. Upon receiving an indication that the trip signal should be overridden, the model may be updated with a pattern that is matched whenever the sensor monitoring that particular entryway generates a trip signal and for which automatic overrides of the trip signal are permissible. The user would therefore only have to indicate a trip signal override for that entryway once, and would never be asked about it again as the security system would automatically override any future trip signals. The pattern may also be based on several indications. For example, a threshold number of override indications for a particular entryway may need to be received from the user before trip signals from the monitoring sensor for that entryway are automatically overridden. For example, a user may be asked to override a trip signal in a particular entryway until they have indicated that the trip signal should be overridden on ten consecutive occasions, at which point the matched pattern may be updated to indicate that automatic overrides are permissible, so that the security system may automatically override future trip signals from the sensor monitoring that particular entryway.

More complex patterns may take into account various other aspects of the state of the security system and/or other components of a smart home environment when a trip signal is generated by a sensor monitoring a particular entryway. These aspects may include, for example, a mode of the security system, the time of day, day of week, day of month, day of year, temperature inside and outside the environment, and the presence of or absence of people within the environment, and state of other sensors connected to the security system. The presence or absence of people within the environment may be determined in any suitable manner, using, for example, WiFi or Bluetooth connections from a mobile device associated with a person, a fob carried by the person, data captured by cameras and/or other sensors within the environment, voice or facial recognition from sensors within the environment, and the like.

For example, a pattern in the model may be based on the temperature outside of a home. The security system may determine that the user indicates that a trip signal from a sensor monitoring a bedroom window should be overridden only when the temperature, or temperature and humidity, outside the home are above a certain threshold, and does not indicate an override when the threshold is not met. The pattern of the model may then include this threshold, so that the user is only asked to override a trip signal from the sensor monitoring the bedroom window when the temperature, or temperature and humidity, falls below the threshold. This may allow a resident of a home to keep a bedroom window open on hot days without having to override the sensor monitoring the bedroom window, while still alerting the resident when the bedroom window is open on cold days.

The patterns in the model may be learned and stored in any suitable manner. For example, the patterns may be parameter based, probabilistic or statistical, or may be based on any suitable machine learning system. The pattern matching required for an automatic override may be exact matching, near matching, or may be matched using, for example, confidence levels output by a machine learning system such as a neural network. For example, with exact matching, the security system may only override a trip signal from a sensor monitoring an entryway when parameters of the state of the security system exactly match the parameters of the state of the security system that are in the pattern in the model, learned from when the user has previously indicated that the trip signal from that entryway sensor should be overridden. Any number of parameters may need to be exactly matched. With confidence levels, a machine learning system may need to output a confidence level that is greater than a particular threshold, for example, 95%, that the state of the security system matches a pattern in the model that indicates that the trip signal can be automatically overridden.

The hub computing device may use a machine learning system to learn when to override trip signals from entryway sensors. The machine learning system may use, as input, the identity of the entryway sensor that has been tripped, along with the current system state for the security system.

The machine learning system may be any suitable machine learning system for determining whether a trip signal should be automatically overridden. The machine learning system may be, for example, a Bayesian network, artificial neural network, support vector machine, or any other suitable statistical or heuristic machine learning system type. The model may be, for example, a set of weights or vectors suitable for use with the machine learning system. The patterns may be encoded in the weights of the model. The machine learning system may be supervised or unsupervised, and may implement any suitable combination of online and offline learning.

For example, the machine learning system may be trained through feedback from a user of the smart home environment, as the machine learning system may send override requests which may be responded to by the user, training the machine learning system as to the correct response to trip signals from different entryway sensors in different states. This learning may be supervised and online. For example, when a trip signal is received from an entryway sensor, the machine learning system may output, based on the trip signal, the system state, and the weights of the model, a confidence level that the trip signal can be overridden. If the confidence level is not over a threshold, for example, 95%, an override request may be sent to a user. If the user responds that the trip signal can be overridden, this may be used as feedback to train the machine learning system, updating the model so that when the same entryway sensor generates a trip signal in the future in a similar system state, the machine learning system may have a higher confidence that the trip signal can be overridden.

The hub computing device may communicate with the user in any suitable manner, and the manner of communication may be based on any suitable criteria. For example, the hub computing device may display messages on an attached display when sensors of the security system detect the presence of the user within the environment, or within the room that includes the hub computing device. The hub computing device may send messages to a smartphone associated with the user when the presence of the user is not detected within the environment, or is detected in a room remote from the hub computing device.

Overrides may be learned for various entryway sensors through an environment. For example, a user may indicate that trip signals from a sensor monitoring a particular internal or external doorway may be overridden when the security system is in a particular state. Future trip signals from the doorway sensor may then be automatically overridden when the security system is in that particular state. Trip signals from other types of sensors may also be overridden. For example, a user may indicate that trip signals from a motion sensor that monitors a room may be overridden at night, as the user may expect some motion in that particular room. Future trip signals from the motion sensor for that particular room may then be overridden when the security system may then be overridden at night, while the motion sensor may still be armed and may not have trip signals that occur during the day overridden.

Learned overrides in the security system may be reset by the user, for example, using the hub computing device or any suitable computing device connected to the security system. For example, the user may decide that they no longer wish for trip signals from a particular window to be overridden when the sensor monitoring the window detects that it is open, as the user may now prefer to keep the window closed and to have an alert or alarm generated when it is open.

FIG. 1 shows an example system suitable for learned overrides according to an implementation of the disclosed subject matter. A hub computing device 100 may include a trip detector 110, a model updater 120, and storage 140. The hub computing device 100 may be any suitable device, such as, for example, a computer 20 as described in FIG. 10, for implementing the trip detector 110, the model updater 120, and the storage 140. The hub computing device 100 may be, for example, a controller 73 as described in FIG. 8. The hub computing device 100 may be a single computing device, or may include multiple connected computing devices, and may be, for example, a smart thermostat, other smart sensor, smartphone, tablet, laptop, desktop, smart television, smart watch, or other computing device that may be able to act as a hub for a smart home environment, which may include a security system. The security system may be controlled from the hub computing device 100. The hub computing device 100 may also include a display. The trip detector 110 may be any suitable combination of hardware or software for detecting and handling trip signals issued by sensors that may be part of the security system and may be connected to the hub computing device 100. The model updater 120 may be any suitable hardware and software for updating patterns in model 141 stored in the storage 140. The model 141 be stored in the storage 140 in any suitable manner.

The hub computing device 100 may be any suitable computing device for acting as the hub of a security system for an environment, such as a home. For example, the hub computing device 100 may be a smart thermostat, which may be connected to various sensors throughout an environment as well as to various systems within the environment, such as HVAC systems, or it may be another device within the smart home environment. The hub computing device 100 may include any suitable hardware and software interfaces through which a user may interact with the hub computing device 100. For example, the hub computing device 100 may include a touchscreen display, or may include web-based or app based interface that can be accessed using another computing device, such as a smartphone, tablet, or laptop. The hub computing device 100 may be located within the same environment as the security system it controls, or may be located offsite. An onsite hub computing device 100 may use computation resources from other computing devices throughout the environment or connected remotely, such as, for example, as part of a cloud computing platform. The hub computing device 100 may be used to arm the security system, using, for example, an interface on the hub computing device 100. The security system may be interacting with by a user in any suitable matter, including through a touch interface or voice interface, and through entry of a PIN, password, or pressing of an "arm" button on the hub computing device 100.

The hub computing device 100 may include a trip detector 110. The trip detector 110 may be any suitable combination of hardware and software for detecting and handling trip signals from sensors connected to the hub computing device 100. For example, the trip detector 110 may detect a trip signal issued by an entryway sensor when the entryway sensor is armed and has detected that the entryway the sensor monitors is open. The trip detector 110 may handle a detected trip signal by, for example, issuing a notification or alert to an appropriate party, such as a resident or occupant of the environment that the particular entryway is open, or sounding a general alert or alarm. When a user of the security system arms the security system, and a trip signal is detected from an entryway sensor, the trip detector 110 may, for example, determine if the state of the security system matches a pattern in the model 141 for which automatic overrides are permissible. If such a pattern is matched, the trip detector 110 may automatically override the trip signal. Otherwise, the trip detector 110 may send a request to the user of the security system asking whether they would like to continue arming the tripping sensor, and bypass or override the trip signal.

The hub computing device 100 may include a model updater 120. The model updater 120 may be any suitable combination of hardware and software for updating the model 141 in the storage 140. The model updater 120 may update patterns in the model 141 based on feedback from a user in response to requests from the trip detector 110 to override a trip signal from an entryway sensor. For example, the model updater 120 may update patterns that correspond to instances where the user has indicated that the trip signal from the entryway sensor should be overridden. The model updater 120 may update the model 141 by, for example, recording various aspects of the state of the security system or applying any suitable machine learning system to the state of the security system when the override request is received from the user. The model updater 120 may establish new patterns when an override request is received from a user and the security system is in a state that doesn't match any previously stored pattern in the model 141. The model updater 120 may also update previously stored patterns, for example, adding more information about the state of the security system when override requests are received, or making automatic overrides permissible for a pattern.

The storage 140 may be any suitable storage hardware connected to the hub computing device 100, and may store the model 141 in any suitable manner. For example, the storage 140 may be a component of the hub computing device, such as a flash memory module or solid state disk, or may be connected to the hub computing device 100 through any suitable wired or wireless connection. It may be a local storage, i.e., within the environment within which the hub computing device operates, or it may be partially or entirely operated by a remote service, such as a cloud-based monitoring service as described in further detail herein. The model 141 may store any number of patterns, which may be representations of states of the security system in which a trip signal from an entryway sensor may or may not be automatically overridden. A pattern may be stored in any suitable format, including, for example, as a set of parameters or conditional clauses, or as weights for a suitable machine learning system. A pattern may apply to one particular entryway sensor or to multiple entryway sensors. The patterns in the model 141 may be developed over time based on feedback from the user regarding override requests. Automatic override of trip signals may or may not be permissible for different patterns. For example, a pattern may not allow for automatic override of a trip signal until the trip signal has been overridden by the user some number of times when the state of the security system matches the pattern.

Figure 2:
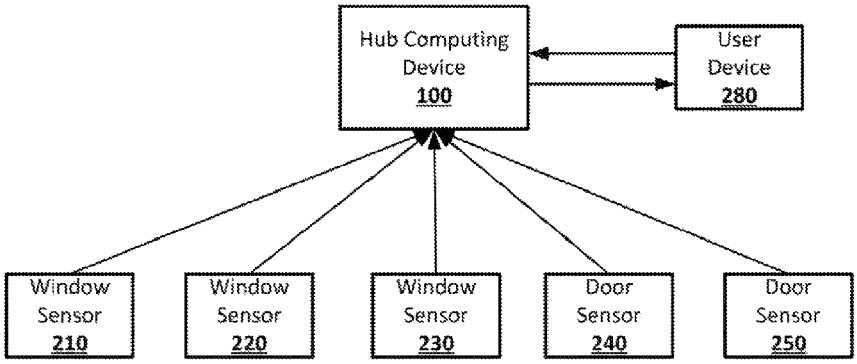
FIG. 2 shows an example arrangement suitable for learned overrides according to an implementation of the disclosed subject matter.

FIG. 2 shows an example arrangement suitable for learned overrides according to an implementation of the disclosed subject matter. The hub computing device 100 may be the hub, or controller, for a smart home environment, including a security system for the environment. Various sensors throughout the environment may be connected to the hub computing device 100. Some of the sensors may be entryway sensors, such as, for example, the window sensors 210, 220, and 230, and the door sensors 240 and 250. Entryway sensors may be any suitable type of sensor, such as contact sensors, including magnetic contact sensors, and tilt sensors, for detecting when an entryway is open. For example, the window sensor 210 may be attached to a bedroom window in a home, and may detect when the bedroom window has been opened. An entryway sensor that has been armed and detects an open entryway may generate a trip signal that may be sent to the hub computing device 100. The trip signal may be displayed on the display of the hub computing device 100, or may be used by the hub computing device 100 to generate an alert, an alarm, or to notify any appropriate party.

The hub computing device 100 may also be connected, in any suitable manner, to a user computing device 280. The user computing device 280 may be any suitable computing device, such as, for example, a smartphone, tablet, laptop, or smartwatch or other wearable computing device, which a user may use to interface with the hub computing device 100 and control the security system. The hub computing device 100 may be able to send alerts or requests to the user computing device 280, either through a direct connection, such as LAN connection, or through a WAN connection such as the Internet. This may allow the user of the user computing device 280 to monitor and manage the security system even when the user is not physically near the hub computing device 100. For example, when the trip detector 110 of the hub computing device 100 detects a trip signal from an entryway sensor such as the window sensor 210, the hub computing device 100 may send a notification, alert, or request for override to the user computing device 280. The user computing device 280 may be used by the user to respond to such a notification, alert, or request for override, for example, by providing an indication to the hub computing device 100 as to whether a trip signal should be overridden.

Figure 3:
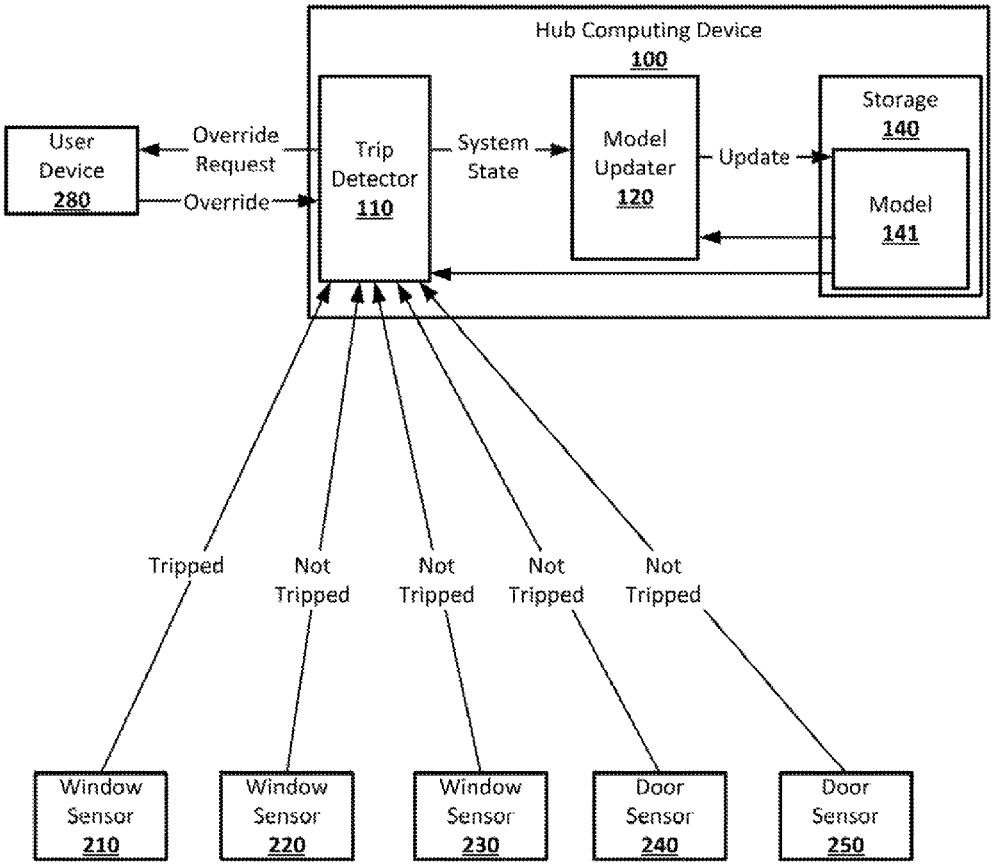
FIG. 3 shows an example arrangement suitable for learned overrides according to an implementation of the disclosed subject matter.

FIG. 3 shows an example arrangement suitable for learned overrides according to an implementation of the disclosed subject matter. A user of the security system may change the mode of the security system to a mode that arms the windows sensors 210, 220, and 230 and the door sensors 240 and 250. For example, the security system may set to an armed home mode, an armed away mode, or a low energy mode. The user may change the mode of the security system using the hub computing device 100 or the user computing device 280.

The hub computing device 100 may arm the window sensors 210, 220, and 230, and the door sensors 240 and 250. Arming the sensors may include communicating with the sensors in order to activate them, or may include actively monitoring signals from the sensors, which may have been ignored when the security system and sensors were not armed. Once the window sensors 210, 220, and 230, and the door sensors 240 and 250 are armed, the trip detector 110 of the hub computing device 100 may actively listen for trip signals from the sensors.

The window being monitored by the window sensor 210 may be open. The window may be open when the window sensor 210 is armed, or may be opened after the window sensor 210 is armed. For example, a resident of a home may arm the security system and may then open a bedroom window, or may have left the bedroom window open prior to arming the security system. The window sensor 210 may detect that the window is open, and may generate a trip signal.

The trip signal generated by the window sensor 210 may be received by the trip detector 110. The trip detector 110 may receive the model 141 from the storage 140, and may check the trip signal and the state of the security system against the patterns in the model 141. The trip signal and the state of the security system may not match any of the patterns in the model 141, or may match a pattern which does not permit the security system to automatically override the trip signal from the window sensor 210. For example, the window monitored by the window sensor 210 may not have been previously left open when the security system was in a state similar to its current state, or the user may have chosen not to override previous trip signals from the window sensor 210.

The trip detector 110 may send an override request to the user. The override request may be sent to the user on the user computing device 280, or may be displayed on a display of the hub computing device 100, for example, depending on whether the security system detects the presence of the user within the environment, or within the room including the hub computing device 100. The override request may indicate to the user that a trip signal has been detected at the window sensor 210, indicating that the window being monitored is open. The override request may ask the user whether this trip signal should be overridden and the window sensor 210 bypassed, allowing the window sensor 210 to remain armed while ignoring trip signals generated by the window sensor 210.

The user may indicate that the trip signal from the window sensor 210 should be overridden. The trip detector 110 may receive the response, and may override the trip signal from the window sensor 210. The trip detector 110 may also send the response and the current state of the security system the model updater 120. The model updater 120 may update the model 141 in the storage 140 using the response to the override request and the currents state of the security system. For example, a new pattern may be added to the model 141, or a previously stored pattern that matches the current state of the security system may be updated to indicate that automatic overrides for the pattern are now permissible when the window sensor 210 trips, or are closer to being permissible.

If the user chooses not to override the trip signal from the window sensor 210, the hub computing device 100 may stop the arming of the security system, including the window sensors 210, 220 and 230 and the door sensors 240 and 250, until the trip signal is cleared by the closing of the window monitored by the window sensor 210. The hub computing device 210 may also continue arming the security system, and may generate a suitable alert or alarm based on the trip signal from the window sensor 210, for example, informing any appropriate party that the window being monitored by the window sensor 210 is open.

Figure 4:
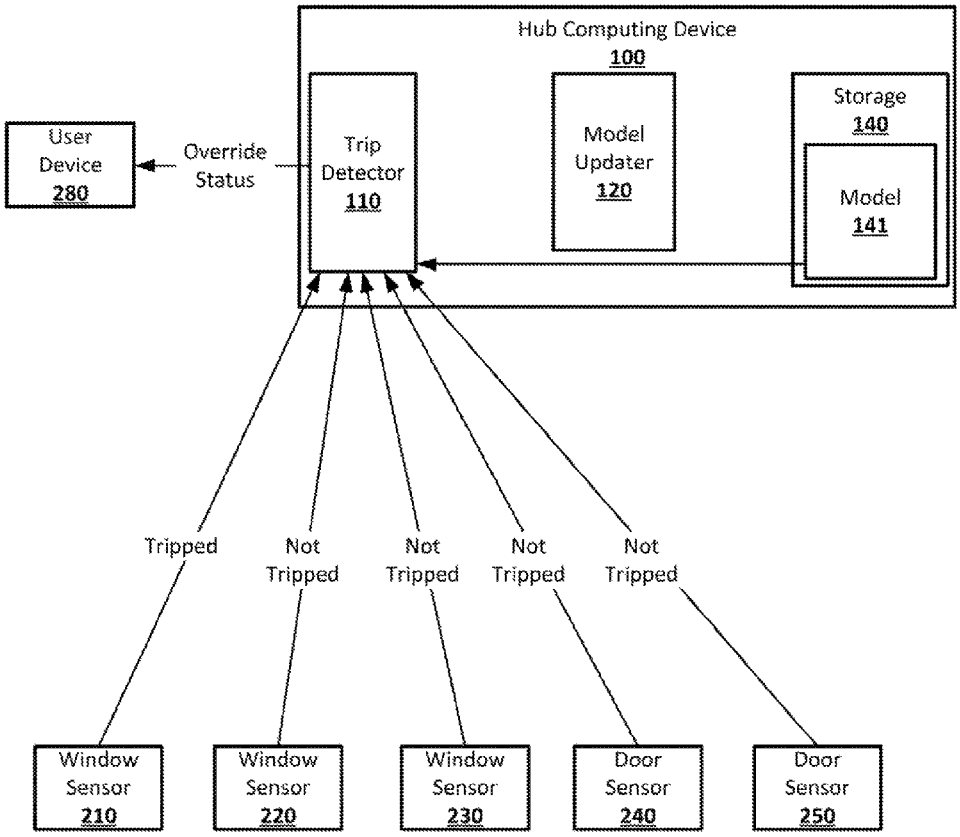
FIG. 4 shows an example arrangement suitable for learned overrides according to an implementation of the disclosed subject matter.

FIG. 4 shows an example arrangement suitable for learned overrides according to an implementation of the disclosed subject matter. A user of the security system may change the mode of the security system to a mode that arms the windows sensors 210, 220, and 230 and the door sensors 240 and 250. For example, the security system may set to an armed home mode, an armed away mode, or a low energy mode. The user may change the mode of the security system using the hub computing device 100 or the user computing device 280.

The hub computing device 100 may arm the window sensors 210, 220, and 230, and the door sensors 240 and 250. Arming the sensors may include communicating with the sensors in order to activate them, or may include actively monitoring signals from the sensors, which may have been ignored when the security system and sensors were not armed. Once the window sensors 210, 220, and 230, and the door sensors 240 and 250 are armed, the trip detector 110 of the hub computing device 100 may actively listen for trip signals from the sensors.

The window being monitored by the window sensor 210 may be open. The window may be open when the window sensor 210 is armed, or may be opened after the window sensor 210 is armed. For example, a resident of a home may arm the security system and may then open a bedroom window, or may have left the bedroom window open prior to arming the security system. The window sensor 210 may detect that the window is open, and may generate a trip signal.

The trip signal generated by the window sensor 210 may be received by the trip detector 110. The trip detector 110 may receive the model 141 from the storage 140, and may check the trip signal and the state of the security system against the patterns in the model 141. The trip signal and the state of the security system may match one of the patterns in the model 141 for which automatic overrides may be permissible. For example, the window monitored by the window sensor 210 may have been previously left open when the security system was in a state similar to its current state, and the user may have chosen to override the previous trip signals.

The trip detector 110 may automatically override the trip signal from the window sensor 210, bypassing the window sensor 210 and allowing the window sensor 210 to remain armed while ignoring trip signals generated by the window sensor 210. The trip detector 110 may send a message to the user indicating that the window sensor 210 has been overridden. For example, the trip detector 110 may send the override status to the user computing device 280, display the message on a display of the hub computing device 100, or communicate with the user in any other suitable manner, for example, based on whether the user is present in the environment and where the user is located.

Figure 5:
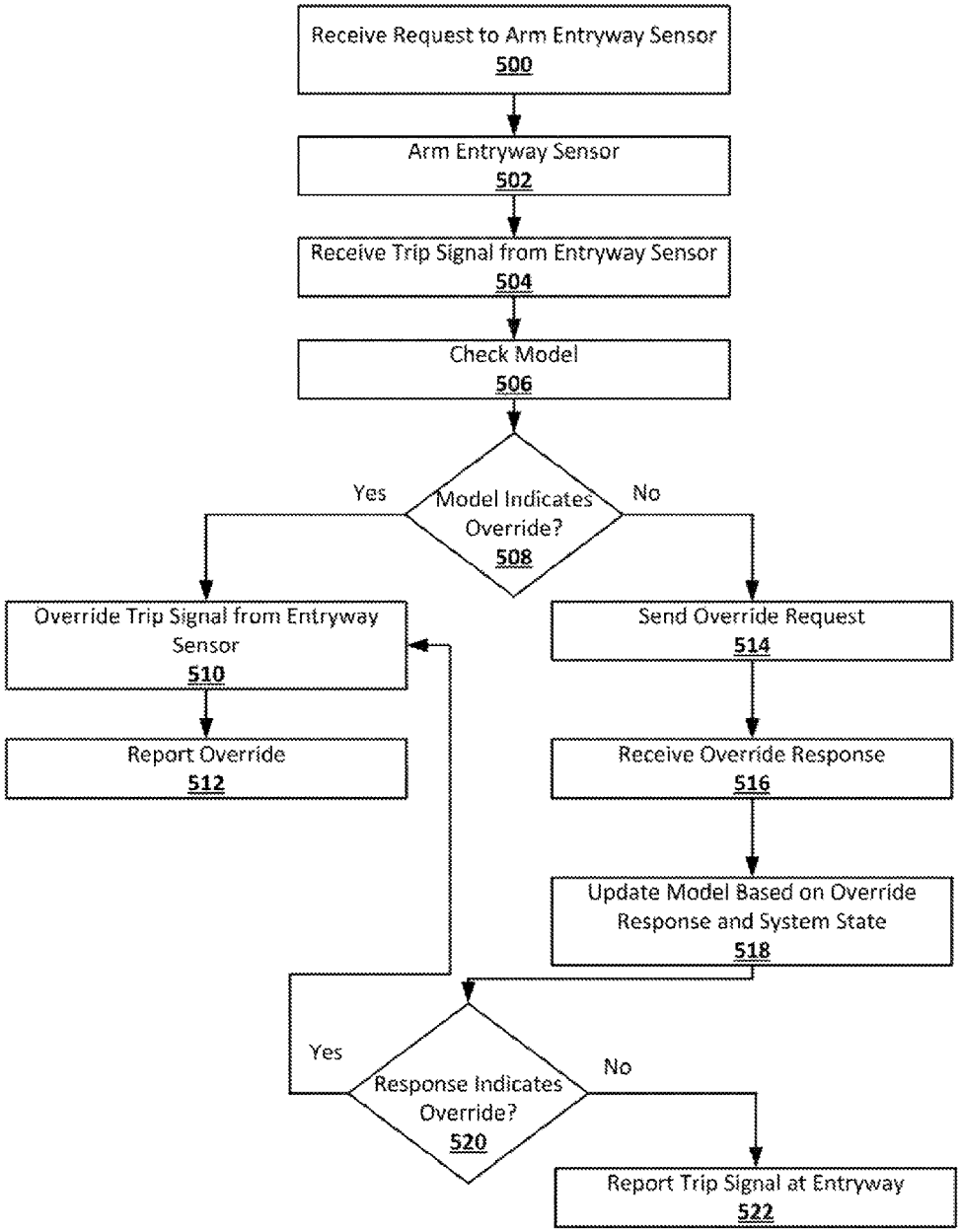
FIG. 5 shows an example of a process suitable for learned overrides according to an implementation of the disclosed subject matter.

FIG. 5 shows an example of a process suitable for learned overrides according to an implementation of the disclosed subject matter. At 500, a request may be received to arm an entryway sensor. For example, the hub computing device 100 may receive a mode selection from a user to place the security system into an armed mode. This may include arming entryway sensors connected to the security system, including the window sensors 210, 220, and 230, and the door sensors 240 and 250.

At 502, the entryway sensor may be armed. For example, selecting the armed mode for the hub computing device 100 may cause the hub computing device 100 to arm any connected entryway sensors, such as the window sensors 210, 220, and 230 and the door sensors 240 and 250. An armed sensor may be monitored for trip signals by the trip detector 110 of the hub computing device 100.

At 504, a trip signal may be received from an entryway sensor. For example, the window being monitored by the window sensor 210 may be opened. The window may have already been opened when the window sensor 210 was armed, or may have been opened after the arming of the window sensor 210. The window sensor 210 may detect that the window is open, and may generate a trip signal. The trip signal may be detected by the trip detector 110 of the hub computing device 100.

At 506, a model may be checked. For example, the trip detector 110 may check the model 141 in the storage 140 to determine if the current state of the security system matches a pattern that permits automatically overriding the trip signal from the window sensor 210.

At 508, it may be determined whether the model indicates an override. For example, the trip detector 110 may determine if any of the patterns in the model 141 match the current state of the security system. Matching may be based on both the current state of the security system and the identity of the sensor that generated the trip signal. For example, a pattern may match the current state of the security system when the trip signal was generated by the window sensor 210, but may not match if the trip signal was generated by the door sensor 250. Another pattern may match the current state of the security system if the trip signal was generated by either the door sensor 240 or 250, but not if the trip signal was generated any of the window sensors 210, 220, and 230. If a pattern matches, the trip detector 110 may determine if that pattern permits automatically overriding the trip signal from the window sensor 210. If the automatic override is permitted, flow may proceed to 510. Otherwise, if no pattern in the model 141 matches the current state of the security system, or there is a matched pattern but it does not permit automatically overriding the trip signal from the window sensor 210, flow proceeds to 514.

At 510, the trip signal from the entryway sensor may be overridden. For example, the trip detector 110 may have found a pattern in the model 141 that matches the current state of the security system and permits automatically overriding the trip signal from the window sensor 210. The trip detector 110 may automatically override the trip signal from the window sensor 210, bypassing the window sensor 210. This may allow the security system to remain armed while the window monitored by the window sensor 210 remains open.

At 512, the override may be reported. For example, a message may be sent to the user computing device 280, or displayed on a display of the hub computing device 100, indicating that the trip signal from the window sensor 210 has been automatically overridden. The message may be sent based, on for example, whether the user is present in the environment and nearby the hub computing device 100, or is elsewhere, as detected by, for example, the security system using any suitable sensors, or based on Wi-Fi, Bluetooth, or Fobs associated with the user.

At 514, an override request may be sent. For example, the trip detector 110 may not have found a pattern in the model 141 that matches the current state of the security system and permits automatically overriding the trip signal from the window sensor 210. A message may be sent to the user computing device 280, or displayed on a display of the hub computing device 100, including an override request for the trip signal from the window sensor 210. The message may be sent based, on for example, whether the user is present in the environment and nearby the hub computing device 100, or is elsewhere, as detected by, for example, the security system using any suitable sensors, or based on Wi-Fi, Bluetooth, or fobs associated with the user.

At 516, an override response may be received. For example, the user, using the user computing device 280, the hub computing device 100, or other suitable computing device on which the override request was received, may respond to the override request. The user may choose whether or not to permit overriding the window sensor 210, and this choice may be received by the hub computing device 100.

At 518, the model may be updated based on the override response and system state. For example, the model updater 120 may use the override response received from the user and the current state of the security system to update patterns in the model 141. The model updater 120 may add a new pattern, or update an existing pattern. For example, if the model 141 includes a pattern that matches the current system state, but not permit overriding the trip signal from the window sensor 210, the model updater 120 may update the pattern based on the override response from the user if the user has indicated that the trip signal from the window sensor 210 should be overridden. If the user has indicated that the trip signal from the window sensor 210 should not be overridden, the pattern may not be updated, or may be updated to reflect the denial of permission to override the trip signal from the window sensor 210. The model updater 120 may also add new patterns to the model 141, if, for example, the current state of the security system does not match any pattern in the model 141. This may allow the security system to learn when to automatically override trip signals from the window sensor 210.

At 520, it may be determined the override response indicates an override. For example, if the override response from the user, received from, for example, the user computing device 280 or through input into the hub computing device 100, indicates that the trip signal from the window sensor 210 can be overridden, flow proceeds to 510. Otherwise, if the response indicates that the trip signal from the window sensor 210 should not be overridden, flow proceeds to 522. At 522, a trip signal may be reported at the entryway. For example, the hub computing device 100 may generate any suitable alert, alarm, or notification, indicating the window monitored by the window sensor 210 is open. This may include sending a message to the user computing device 280, displaying a message on the display of the hub computing device 100, notifying an appropriate party such as a security company, or providing an alarm through use of sounds or lights.

Figure 6:
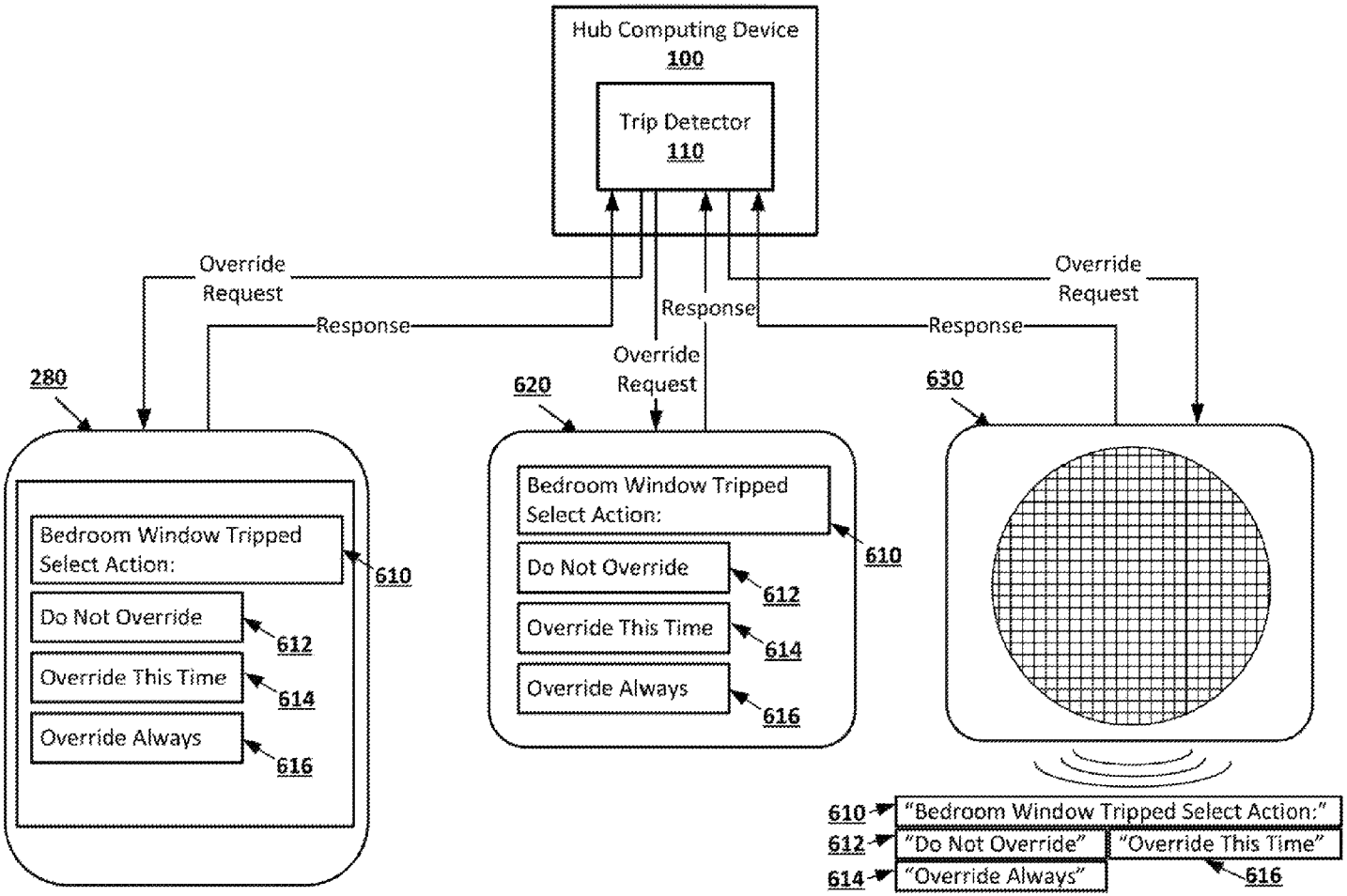
FIG. 6 shows an example arraignment suitable for learned overrides according to an implementation of the disclosed subject matter.

FIG. 6 shows an example arrangement suitable for learned overrides according to an implementation of the disclosed subject matter. The trip detector 110 may send override requests to a user of the security system in any suitable manner. For example, an override request may be sent to the display of the user computing device 280, a display 620 of the hub computing device 100 or other computing device within the smart home environment, or to a speaker 630, which may be, for example, part of a hazard detector, within the smart home environment. The override request may be sent any number of displays or speakers, which may be chosen, for example, based on their proximity to the user the mode change request is sent to. For example, if the user is currently an occupant of the environment and is near the speaker 630, the speaker 630 may be used to communicate the override request to the user. If the user is absent from the environment, the override request may be sent to the user computing device 280, which may be, for example, the user's smartphone. The override request may include, for example, a request 610, which may explain in written form or verbally that the trip detector 130 has determined that an entryway sensor has been tripped, including an identification of the entryway, along with response options, such as do not override option 612, override always option 614, and override this time option 616. The user may review the request 610 and respond in an appropriate manner, for example, using a touchscreen user interface on smartphone or a verbal response to the speaker 630 to select the do not override option 612, the override always option 614, or the override this time option 616. The user's response may be sent back to the mode selector trip detector 130, which may then act in accordance with the response. For example, if the user selects the do not override option 612, the trip detector 110 may not override the trip signal from the entryway sensor, and may generate any suitable alarm, alert, or notification. If the user selects the override always option 614, the trip detector 110 may override the trip signal from the entryway sensor, the model updater 120 may update the model 141 to indicate that the particular trip signal in that particular system state should always be overridden. If the user selects the override this time option 616, the trip detector 110 may override the trip signal from the entryway sensor, and the model updater 120 may update the model 141 based on the override response. The model updater 120 may add a new pattern, or update an existing pattern in the model 141, which may allow the security system to learn when to automatically override the trip signal, though may not yet result in future trip signals from the same entryway in the same system state being overridden.

Embodiments disclosed herein may use one or more sensors. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. In some cases, a sensor may operate as multiple sensor types sequentially or concurrently, such as where a temperature sensor is used to detect a change in temperature, as well as the presence of a person or animal.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor or a sensor device. For clarity, sensors are described with respect to the particular functions they perform and/or the particular physical hardware used, when such specification is necessary for understanding of the embodiments disclosed herein.

Figure 7:
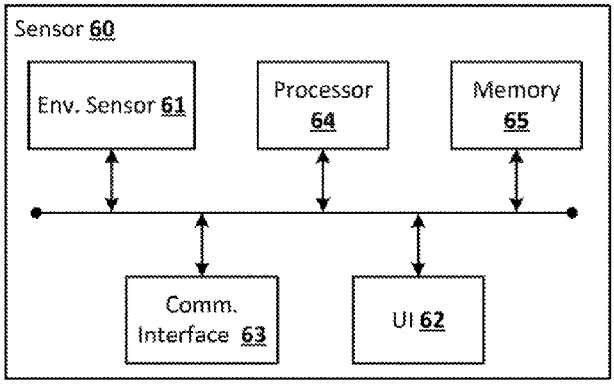
FIG. 7 shows a computing device according to an embodiment of the disclosed subject matter.

A sensor may include hardware in addition to the specific physical sensor that obtains information about the environment. FIG. 7 shows an example sensor as disclosed herein. The sensor 60 may include an environmental sensor 61, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, or any other suitable environmental sensor, that obtains a corresponding type of information about the environment in which the sensor 60 is located. A processor 64 may receive and analyze data obtained by the sensor 61, control operation of other components of the sensor 60, and process communication between the sensor and other devices. The processor 64 may execute instructions stored on a computer-readable memory 65. The memory 65 or another memory in the sensor 60 may also store environmental data obtained by the sensor 61. A communication interface 63, such as a Wi-Fi or other wireless interface, Ethernet or other local network interface, or the like may allow for communication by the sensor 60 with other devices. A user interface (UI) 62 may provide information and/or receive input from a user of the sensor. The UI 62 may include, for example, a speaker to output an audible alarm when an event is detected by the sensor 60. Alternatively, or in addition, the UI 62 may include a light to be activated when an event is detected by the sensor 60. The user interface may be relatively minimal, such as a limited-output display, or it may be a full-featured interface such as a touchscreen. Components within the sensor 60 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

Sensors as disclosed herein may operate within a communication network, such as a conventional wired or wireless network, mesh network, and/or a sensor-specific network through which sensors may communicate with one another and/or with dedicated other devices. In some configurations one or more sensors may provide information to one or more other sensors, to a central controller, or to any other device capable of communicating on a network with the one or more sensors. A central controller may be general- or special-purpose. For example, one type of central controller is a home automation network, which collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Alternatively or in addition, a central controller as disclosed herein may be remote from the sensors, such as where the central controller is implemented as a cloud-based system that communicates with multiple sensors, which may be located at multiple locations and may be local or remote with respect to one another.

Figure 8:
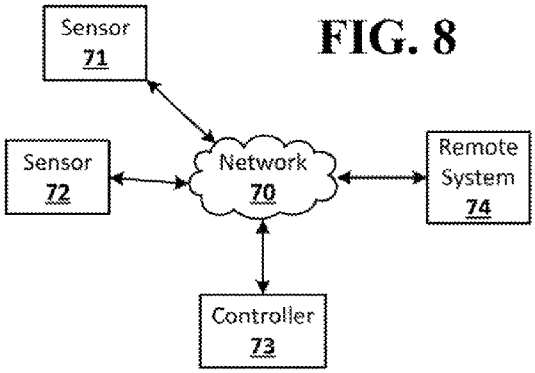
FIG. 8 shows a system according to an embodiment of the disclosed subject matter.

FIG. 8 shows an example of a sensor network as disclosed herein, which may be implemented over any suitable wired and/or wireless communication networks. One or more sensors 71, 72 may communicate via a local network 70, such as a Wi-Fi or other suitable network, with each other and/or with a controller 73. The network may be in any suitable configuration, such as, for example, a mesh network. The controller may be a general- or special-purpose computer. The controller may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors may communicate directly with a remote system 74. The remote system 74 may, for example, aggregate data from multiple locations, provide instruction, software updates, and/or aggregated data to a controller 73 and/or sensors 71, 72.

For example, the hub computing device 100, the window sensors 210, 220, and 230, and the door sensors 240 and 250 may be examples of a controller 73 and sensors 71 and 72, as shown and described in further detail with respect to FIGS. 1-4.

The devices of the security system and smart-home environment of the disclosed subject matter may be communicatively connected via the network 70, which may be a mesh-type network such as Thread, which provides network architecture and/or protocols for devices to communicate with one another. Typical home networks may have a single device point of communications. Such networks may be prone to failure, such that devices of the network cannot communicate with one another when the single device point does not operate normally. The mesh-type network of Thread, which may be used in the security system of the disclosed subject matter, may avoid communication using a single device. That is, in the mesh-type network, such as network 70, there is no single point of communication that may fail so as to prohibit devices coupled to the network from communicating with one another.

The communication and network protocols used by the devices communicatively coupled to the network 70 may provide secure communications, minimize the amount of power used (i.e., be power efficient), and support a wide variety of devices and/or products in a home, such as appliances, access control, climate control, energy management, lighting, safety, and security. For example, the protocols supported by the network and the devices connected thereto may have an open protocol which may carry IPv6 natively.

The Thread network, such as network 70, may be easy to set up and secure to use. The network 70 may use an authentication scheme, AES (Advanced Encryption Standard) encryption, or the like to reduce and/or minimize security holes that exist in other wireless protocols. The Thread network may be scalable to connect devices (e.g., 2, 5, 10, 20, 50, 100, 150, 200, or more devices) into a single network supporting multiple hops (e.g., so as to provide communications between devices when one or more nodes of the network is not operating normally). The network 70, which may be a Thread network, may provide security at the network and application layers. One or more devices communicatively coupled to the network 70 (e.g., controller 73, remote system 74, and the like) may store product install codes to ensure only authorized devices can join the network 70. One or more operations and communications of network 70 may use cryptography, such as public-key cryptography.

The devices communicatively coupled to the network 70 of the smart-home environment and/or security system disclosed herein may low power consumption and/or reduced power consumption. That is, devices efficiently communicate to with one another and operate to provide functionality to the user, where the devices may have reduced battery size and increased battery lifetimes over conventional devices. The devices may include sleep modes to increase battery life and reduce power requirements. For example, communications between devices coupled to the network 70 may use the power-efficient IEEE 802.15.4 MAC/PHY protocol. In embodiments of the disclosed subject matter, short messaging between devices on the network 70 may conserve bandwidth and power. The routing protocol of the network 70 may reduce network overhead and latency. The communication interfaces of the devices coupled to the smart-home environment may include wireless system-on-chips to support the low-power, secure, stable, and/or scalable communications network 70.

The sensor network shown in FIG. 8 may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 8 may include a plurality of devices, including intelligent, multi-sensing, network-connected devices that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIG. 8.

According to embodiments of the disclosed subject matter, the smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIG. 8, and the controller 73 may control the HVAC system (not shown) of the structure.

A smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIG. 8, and the controller 73 may control an alarm system to provide a visual and/or audible alarm to the user of the smart-home environment.

A smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some embodiments, the smart-home environment of the sensor network shown in FIG. 8 may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be the sensors 71, 72 shown in FIG. 8. The smart wall switches may detect ambient lighting conditions, and control a power and/or dim state of one or more lights. For example, the sensors 71, 72, may detect the ambient lighting conditions, and the controller 73 may control the power to one or more lights (not shown) in the smart-home environment. The smart wall switches may also control a power state or speed of a fan, such as a ceiling fan. For example, sensors 72, 72 may detect the power and/or speed of a fan, and the controller 73 may adjusting the power and/or speed of the fan, accordingly. The smart wall plugs may control supply of power to one or more wall plugs (e.g., such that power is not supplied to the plug if nobody is detected to be within the smart-home environment). For example, one of the smart wall plugs may controls supply of power to a lamp (not shown).

In embodiments of the disclosed subject matter, the smart-home environment may include one or more intelligent, multi-sensing, network-connected entry detectors (e.g., "smart entry detectors"). The sensors 71, 72 shown in FIG. 8 may be the smart entry detectors. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some embodiments of the disclosed subject matter, the alarm system, which may be included with controller 73 and/or coupled to the network 70 may not arm unless all smart entry detectors (e.g., sensors 71, 72) indicate that all doors, windows, entryways, and the like are closed and/or that all smart entry detectors are armed.

The smart-home environment of the sensor network shown in FIG. 8 can include one or more intelligent, multi-sensing, network-connected doorknobs (e.g., "smart doorknob"). For example, the sensors 71, 72 may be coupled to a doorknob of a door (e.g., doorknobs 122 located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of the smart-home environment (e.g., as illustrated as sensors 71, 72 of FIG. 8 can be communicatively coupled to each other via the network 70, and to the controller 73 and/or remote system 74 to provide security, safety, and/or comfort for the smart home environment).

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, a tablet, a key FOB, and the like). A webpage or application can be configured to receive communications from the user and control the one or more of the network-connected smart devices based on the communications and/or to present information about the device's operation to the user. For example, the user can view can arm or disarm the security system of the home.

One or more users can control one or more of the network-connected smart devices in the smart-home environment using a network-connected computer or portable electronic device. In some examples, some or all of the users (e.g., individuals who live in the home) can register their mobile device and/or key FOBs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As such, the smart-home environment "learns" who is a user (e.g., an authorized user) and permits the electronic devices associated with those individuals to control the network-connected smart devices of the smart-home environment (e.g., devices communicatively coupled to the network 70). Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

The smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

The controller 73 and/or remote system 74 can control the outdoor lighting system based on information received from the other network-connected smart devices in the smart-home environment. For example, in the event, any of the network-connected smart devices, such as smart wall plugs located outdoors, detect movement at night time, the controller 73 and/or remote system 74 can activate the outdoor lighting system and/or other lights in the smart-home environment.

Figure 9:
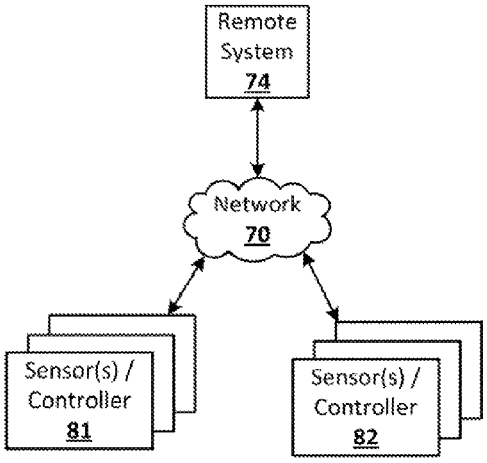
FIG. 9 shows a system according to an embodiment of the disclosed subject matter.

In some configurations, a remote system 74 may aggregate data from multiple locations, such as multiple buildings, multi-resident buildings, individual residences within a neighborhood, multiple neighborhoods, and the like. In general, multiple sensor/controller systems 81, 82 as previously described with respect to FIG. 9 may provide information to the remote system 74. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. Thus, the user may have control over how information is collected about the user and used by a system as disclosed herein.

Figure 10:
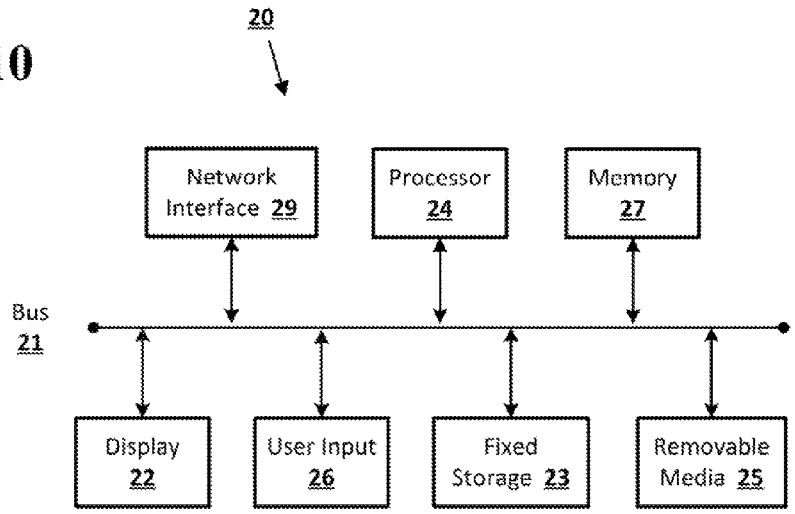
FIG. 10 shows a computer according to an embodiment of the disclosed subject matter.

Embodiments of the presently disclosed subject matter may be implemented in and used with a variety of computing devices. FIG. 10 is an example computing device 20 suitable for implementing embodiments of the presently disclosed subject matter. For example, the device 20 may be used to implement a controller, a device including sensors as disclosed herein, or the like. Alternatively or in addition, the device 20 may be, for example, a desktop or laptop computer, or a mobile computing device such as a smart phone, tablet, or the like. The device 20 may include a bus 21 which interconnects major components of the computer 20, such as a central processor 24, a memory 27 such as Random Access Memory (RAM), Read Only Memory (ROM), flash RAM, or the like, a user display 22 such as a display screen, a user input interface 26, which may include one or more controllers and associated user input devices such as a keyboard, mouse, touch screen, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the computer 20 are generally stored on and accessed via a computer readable storage medium.

The fixed storage 23 may be integral with the computer 20 or may be separate and accessed through other interfaces. The network interface 29 may provide a direct connection to a remote server via a wired or wireless connection. The network interface 29 may provide such connection using any suitable technique and protocol as will be readily understood by one of skill in the art, including digital cellular telephone, WiFi, Bluetooth®, near-field, and the like. For example, the network interface 29 may allow the device to communicate with other computers via one or more local, wide-area, or other communication networks, as described in further detail herein.

Figure 11:
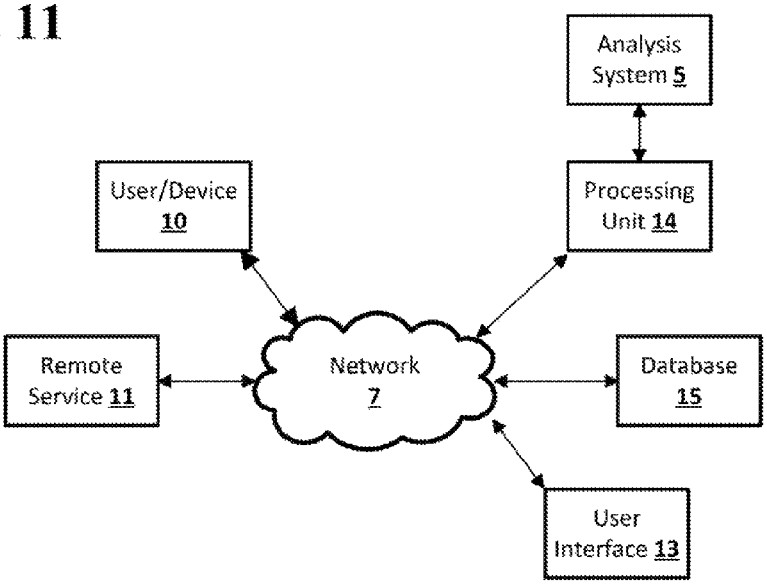
FIG. 11 shows a network configuration according to an embodiment of the disclosed subject matter.

FIG. 11 shows an example network arrangement according to an embodiment of the disclosed subject matter. One or more devices 10, 11, such as local computers, smart phones, tablet computing devices, and the like may connect to other devices via one or more networks 7. Each device may be a computing device as previously described. The network may be a local network, wide-area network, the Internet, or any other suitable communication network or networks, and may be implemented on any suitable platform including wired and/or wireless networks. The devices may communicate with one or more remote devices, such as servers 13 and/or databases 15. The remote devices may be directly accessible by the devices 10, 11, or one or more other devices may provide intermediary access such as where a server 13 provides access to resources stored in a database 15. The devices 10, 11 also may access remote platforms 17 or services provided by remote platforms 17 such as cloud computing arrangements and services. The remote platform 17 may include one or more servers 13 and/or databases 15.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A method for learning overrides of a security system, the method comprising:

receiving a trip signal indicating a tripping of a security system sensor;

sending, when an automatic override of the trip signal is not permitted by a model, an override request to a user device;

receiving a response to the override request, wherein the response indicates the trip signal is to be overridden; and updating, after receiving at least a set number of override responses indicating a respective trip signal from the security system sensor is to be overridden, the model to automatically override a subsequent trip signal received from the security system sensor.

2. The method of claim 1, further comprising determining the trip signal cannot be automatically overridden, wherein:

the determining is based on matching both an identity of the security system sensor and a current state of the security system with at least one pattern;

the at least one pattern is incorporated in the model; and the at least one pattern represents a possible state of the security system.

3. The method of claim 2, wherein the matching is based on at least one of parameter-based matching, probabilistic matching, statistical matching, or machine learning-based matching.

4. The method of claim 3, wherein the at least one pattern in the model is one or more of parameter-based, probabilistic, statistical, or machine learning-based.

5. The method of claim 2, wherein the possible state of the security system comprises one or more parameters selected from the group consisting of:

a state of other sensors coupled to the security system;

a presence of one or more persons within an environment monitored by the security system;

a time of day;

a day of the week;

a day of the month;

a month of the year;

a climate within the environment monitored by the security system;

a climate outside the environment monitored by the security system; and a mode of the security system.

6. The method of claim 1, further comprising:

receiving a second trip signal indicating a tripping of a second security system sensor;

determining that the second trip signal from the second security system sensor cannot be automatically overridden, wherein the determining is based on either:

matching both an identity of the second security system sensor and a current state of the security system with the at least one pattern in the model, wherein the at least one pattern represents a possible state of the security system in which automatically overriding the second trip signal from the security system sensor is not permitted, or not matching both the identity of the second security system sensor and the current state of the security system with any pattern in the model; and sending a second override request to the security system speaker.

7. The method of claim 6, further comprising:

receiving a response to the second override request, wherein the response to the second override request indicates the second trip signal is to be overridden;

overriding the second trip signal; and updating the model to automatically override a subsequent trip signal received from the second security system sensor, wherein the updating the model comprises either:

adding a new pattern to the model, or updating the at least one pattern.

8. The method of claim 7, wherein the response to the second override request is received from the security system speaker.

9. The method of claim 6, further comprising:

receiving a response to the second override request, wherein the response to the second override request indicates the second trip signal from the second security system sensor is not to be overridden; and generating at least one of an alarm, an alert, or a notification indicating that the second security system sensor has generated the second trip signal.

10. The method of claim 9, wherein the response to the second override request is received from the security system speaker.

11. The method of claim 1, wherein the security system sensor remains armed while the trip signal from the security system sensor is overridden.

12. The method of claim 1, wherein the response is received from the security system speaker.

13. A system for learning overrides, comprising:

a storage device configured to store data describing a model, wherein the model comprises at least one pattern representing a state of a security system; and a computing device configured to:

receive a trip signal indicating a tripping of a security system sensor;

send, when an automatic override of the trip signal is not permitted by the model, an override request to a user device;

receive a response to the override request, wherein the response indicates the trip signal is to be overridden; and update, after receiving at least a set number of override responses indicating a respective trip signal from the security system sensor is to be overridden, the model to automatically override a subsequent trip signal received from the security system sensor.

14. The system of claim 13, wherein the computing device further comprises the security system speaker.

15. The system of claim 13, wherein the computing device is further configured to send a notification of a trip signal override to the security system speaker.

16. The system of claim 13, wherein the computing device is further configured to determine the trip signal cannot be automatically overridden, based on:

a current state of the security system and an identity of the security system sensor having a match the at least one pattern incorporated in the model; and the at least one pattern does not permit automatically overriding the trip signal from the security system sensor.

17. The system of claim 16, wherein the match is based on at least one of parameter-based matching, probabilistic matching, statistical matching, or machine learning-based matching.

18. The system of claim 17, wherein the at least one pattern in the model is one or more of parameter-based, probabilistic, statistical, or machine learning-based.

19. The system of claim 16, wherein a possible state of the security system comprises one or more parameters selected from the group consisting of:

a state of other sensors coupled to the security system;

a presence of one or more persons within an environment monitored by the security system;

a time of day;

a day of the week;

a day of the month;

a month of the year;

a climate within the environment monitored by the security system;

a climate outside the environment monitored by the security system; and a mode of the security system.

20. The system of claim 13, wherein the computing device is further configured to:

receive a second trip signal indicating a tripping of a second security system sensor;

determine that the second trip signal from the second security system sensor cannot be automatically overridden, wherein the a determination is based on either:

matching both an identity of the second security system sensor and a current state of the security system with the at least one pattern in the model, wherein the at least one pattern represents a possible state of the security system in which automatically overriding the second trip signal from the security system sensor is not permitted, or not matching both the identity of the second security system sensor and the current state of the security system with any pattern in the model; and send a second override request to the security system speaker.

21. The system of claim 20, wherein the computing device is further configured to:

receive a response to the second override request, wherein the response to the second override request indicates the second trip signal is to be overridden;

override the second trip signal; and update the model to automatically override a subsequent trip signal received from the second security system sensor, wherein an updating of the model comprises either:

adding a new pattern to the model, or updating the at least one pattern.

22. The system of claim 21, wherein the computing device is further configured to receive the response to the second override request from the security system speaker.

23. The system of claim 20, wherein the computing device is further configured to:

receive a response to the second override request, wherein the response to the second override request indicates the second trip signal from the second security system sensor is not to be overridden; and generate at least one of an alarm, an alert, or a notification indicating that the second security system sensor has generated the second trip signal.

24. The system of claim 23, wherein the computing device is further configured to receive the response to the second override request from the security system speaker.

25. The system of claim 13, wherein the computing device is further configured to receive the response from the security system speaker.

26. A non-transitory computer-readable media, comprising processor-executable instructions stored thereon configured to cause a processor to:

receive a trip signal indicating a tripping of a security system sensor;

send, when an automatic override of the trip signal is not permitted by a model, an override request to a user device;

receive a response to the override request, wherein the response indicates the trip signal is to be overridden; and update, after receiving at least a set number of override responses indicating a respective trip signal from the security system sensor is to be overridden, the model to automatically override a subsequent trip signal received from the security system sensor.

27. The non-transitory computer-readable media of claim 26, wherein the processor-executable instructions are further configured to cause the processor to:

determine if the trip signal cannot be automatically overridden, wherein:

a determination is based on matching both an identity of the security system sensor and a current state of the security system with at least one pattern;

the at least one pattern is incorporated in the model; and the at least one pattern represents a possible state of the security system.

28. The non-transitory computer-readable media of claim 27, wherein the matching is based on at least one of parameter-based matching, probabilistic matching, statistical matching, or machine learning-based matching.

29. The non-transitory computer-readable media of claim 28, wherein the at least one pattern in the model is one or more of parameter-based, probabilistic, statistical, or machine learning-based.

30. The non-transitory computer-readable media of claim 27, wherein the possible state of the security system comprises one or more parameters selected from the group consisting of:

a state of other sensors coupled to the security system;

a presence of one or more persons within an environment monitored by the security system;

a time of day;

a day of the week;

a day of the month;

a month of the year;

a climate within the environment monitored by the security system;

a climate outside the environment monitored by the security system; and a mode of the security system.

31. The non-transitory computer-readable media of claim 26, wherein the processor-executable instructions are further configured to cause the processor to:

receive a second trip signal indicating a tripping of a second security system sensor;

determine that the second trip signal from the second security system sensor cannot be automatically overridden, wherein a determination is based on either:

matching both an identity of the second security system sensor and a current state of the security system with the at least one pattern in the model, wherein the at least one pattern represents a possible state of the security system in which automatically overriding the second trip signal from the security system sensor is not permitted, or not matching both the identity of the second security system sensor and the current state of the security system with any pattern in the model; and send a second override request to the security system speaker.

32. The non-transitory computer-readable media of claim 31, wherein the processor-executable instructions are further configured to cause the processor to:

receive a response to the second override request, wherein the response to the second override request indicates the second trip signal is to be overridden;

override the second trip signal; and update the model to automatically override a subsequent trip signal received from the second security system sensor, wherein an updating of the model comprises either:

adding a new pattern to the model, or updating the at least one pattern.

33. The non-transitory computer-readable media of claim 32, wherein the processor-executable instructions are further configured to cause the processor to receive the response from the security system speaker.

34. The non-transitory computer-readable media of claim 31, wherein the processor-executable instructions are further configured to cause the processor to:

receive a response to the second override request, wherein the response to the second override request indicates the second trip signal from the second security system sensor is not to be overridden; and generate at least one of an alarm, an alert, or a notification indicating that the second security system sensor has generated the second trip signal.

35. The non-transitory computer-readable media of claim 34, wherein the processor-executable instructions are further configured to cause the processor to receive the response from the security system speaker.

36. The non-transitory computer-readable media of claim 26, wherein the processor-executable instructions are further configured to cause the processor to receive the response from the security system speaker.

* * * * *